US010309251B2

(12) United States Patent
Sandoval et al.

(10) Patent No.: US 10,309,251 B2
(45) Date of Patent: Jun. 4, 2019

(54) INTERLOCKING ROTOR ASSEMBLY WITH THERMAL SHIELD

(71) Applicant: United Technologies Corporation, Hartford, CT (US)

(72) Inventors: Jonathan Perry Sandoval, Hebron, CT (US); Julian Partyka, West Springfield, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 799 days.

(21) Appl. No.: 14/770,832

(22) PCT Filed: Mar. 10, 2014

(86) PCT No.: PCT/US2014/022507
§ 371 (c)(1),
(2) Date: Aug. 27, 2015

(87) PCT Pub. No.: WO2014/150182
PCT Pub. Date: Sep. 25, 2014

(65) Prior Publication Data

US 2016/0003097 A1 Jan. 7, 2016

Related U.S. Application Data

(60) Provisional application No. 61/787,277, filed on Mar. 15, 2013.

(51) Int. Cl.
*F01D 25/08* (2006.01)
*F01D 25/02* (2006.01)
(Continued)

(52) U.S. Cl.
CPC ..... *F01D 25/08* (2013.01); *F01D 5/025* (2013.01); *F01D 5/066* (2013.01); *F01D 5/3015* (2013.01);
(Continued)

(58) Field of Classification Search
CPC ..... F01D 25/08; F01D 5/025; F01D 5/066; F01D 5/3015; F01D 2260/33; F01D 2260/36; F05D 2260/33; F05D 2260/36
(Continued)

(56) References Cited

U.S. PATENT DOCUMENTS 4,787,821 A * 11/1988 Cruse ..... B23K 20/021 228/118
5,358,374 A 10/1994 Correia et al.
(Continued)

FOREIGN PATENT DOCUMENTS

EP 2137382 5/2012
JP 57119110 7/1982

OTHER PUBLICATIONS

International Preliminary Report on Patentability for PCT Application No. PCT/US2014/022507 dated Sep. 24, 2015.
(Continued)

*Primary Examiner* — Mark A Laurenzi
*Assistant Examiner* — Paul W Thiede
(74) *Attorney, Agent, or Firm* — Carlson, Gaskey & Olds, P.C.

(57) ABSTRACT

A rotor assembly includes a first rotor, a second rotor mounted on the first rotor and co-rotatable there with, and a thermal shield interlocked with the second rotor for co-rotation there with.

13 Claims, 4 Drawing Sheets

(51) Int. Cl.

| | |
|---|---|
| ***F01D 5/30*** | (2006.01) |
| ***F01D 5/06*** | (2006.01) |
| ***F01D 5/02*** | (2006.01) |

(52) U.S. Cl.
CPC ..... *F05D 2260/33* (2013.01); *F05D 2260/36* (2013.01)

(58) Field of Classification Search
USPC ..... 416/126, 182
See application file for complete search history.

(56) References Cited

U.S. PATENT DOCUMENTS

| | | | |
|---|---|---|---|
| 2003/0017050 | A1 | 1/2003 | Simeone et al. |
| 2004/0009060 | A1 | 1/2004 | Romani et al. |
| 2012/0051918 | A1 | 3/2012 | Glasspoole et al. |
| 2012/0177495 | A1 | 7/2012 | Virkler et al. |
| 2012/0219405 | A1 | 8/2012 | Szwedowicz et al. |

OTHER PUBLICATIONS

European Search Report for European Patent Application No. 14769982 completed Sep. 21, 2016.
The International Search Report and Written Opinion for PCT Application No. PCT/US2014/022507, dated Jul. 1, 2014.

* cited by examiner

INTERLOCKING ROTOR ASSEMBLY WITH THERMAL SHIELD

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

The high pressure turbine drives the high pressure compressor through an outer shaft to form a high spool, and the low pressure turbine drives the low pressure compressor through an inner shaft to form a low spool. The fan section may also be driven by the low inner shaft. A direct drive gas turbine engine includes a fan section driven by the low spool such that the low pressure compressor, low pressure turbine and fan section rotate at a common speed in a common direction.

A speed reduction device, such as an epicyclical gear assembly, may be utilized to drive the fan section such that the fan section may rotate at a speed different than the turbine section. In such engine architectures, a shaft driven by one of the turbine sections provides an input to the epicyclical gear assembly that drives the fan section at a reduced speed.

SUMMARY

A rotor assembly according to an example of the present disclosure includes a first rotor, a second rotor mounted on the first rotor and co-rotatable there with, and a thermal shield interlocked with the second rotor for co-rotation there with.

In a further embodiment of any of the foregoing embodiments, the first rotor has a first outer diameter and the second rotor has a second outer diameter that is smaller than the first outer diameter.

In a further embodiment of any of the foregoing embodiments, the second rotor includes at least one radially-extending tab and the thermal shield includes at least one radially-extending tab circumferentially interlocked with the at least one radially-extending tab of the second rotor.

In a further embodiment of any of the foregoing embodiments, the one radially-extending tab of the second rotor includes a step.

In a further embodiment of any of the foregoing embodiments, the second rotor includes a plurality of radially-extending circumferentially-spaced tabs and the thermal shield includes a plurality of radially-extending circumferentially-spaced tabs circumferentially interlocked with the plurality of radially-extending circumferentially-spaced tabs of the second rotor.

In a further embodiment of any of the foregoing embodiments, the first rotor includes a plurality of radially-extending circumferentially-spaced tabs and the plurality of radially-extending circumferentially-spaced tabs of the second rotor are circumferentially interlocked with the plurality of radially-extending circumferentially-spaced tabs of the first rotor.

In a further embodiment of any of the foregoing embodiments, the plurality of radially-extending circumferentially-spaced tabs of the thermal shield are circumferentially aligned with the plurality of radially-extending circumferentially-spaced tabs of the first rotor.

In a further embodiment of any of the foregoing embodiments, the plurality of radially-extending circumferentially-spaced tabs of the thermal shield are axially trapped between the second rotor and the plurality of radially-extending circumferentially-spaced tabs of the first rotor.

In a further embodiment of any of the foregoing embodiments, the second rotor includes a plurality of radially outwardly-extending circumferentially-spaced tabs and the thermal shield includes a plurality of radially inwardly-extending circumferentially-spaced tabs circumferentially interlocked with the plurality of radially outwardly-extending circumferentially-spaced tabs of the second rotor.

In a further embodiment of any of the foregoing embodiments, the second rotor includes an axially-facing pocket, and a portion of the thermal shield is seated in the axially-facing pocket.

In a further embodiment of any of the foregoing embodiments, the thermal shield is a continuous ring.

A gas turbine engine according to an example of the present disclosure includes a first rotor, a second rotor mounted on the first rotor and co-rotatable there with, and a thermal shield interlocked with the second rotor for co-rotation there with.

A method of assembling a rotor assembly according to an example of the present disclosure includes interlocking a thermal shield with a second rotor for co-rotation there with. The second rotor is mounted on a first rotor and co-rotatable there with.

In a further embodiment of any of the foregoing embodiments, the interlocking includes mounting the thermal shield on the second rotor and rotating the thermal shield to circumferentially misalign at least one tab on the thermal shield with at least one tab on the second rotor.

In a further embodiment of any of the foregoing embodiments, the tab on the thermal shield is axially offset with respect to the tab on the second rotor.

In a further embodiment of any of the foregoing embodiments, the interlocking moves the second rotor relative to the thermal shield to axially align, and circumferentially interlock, the tab on the thermal shield with the tab on the second rotor.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
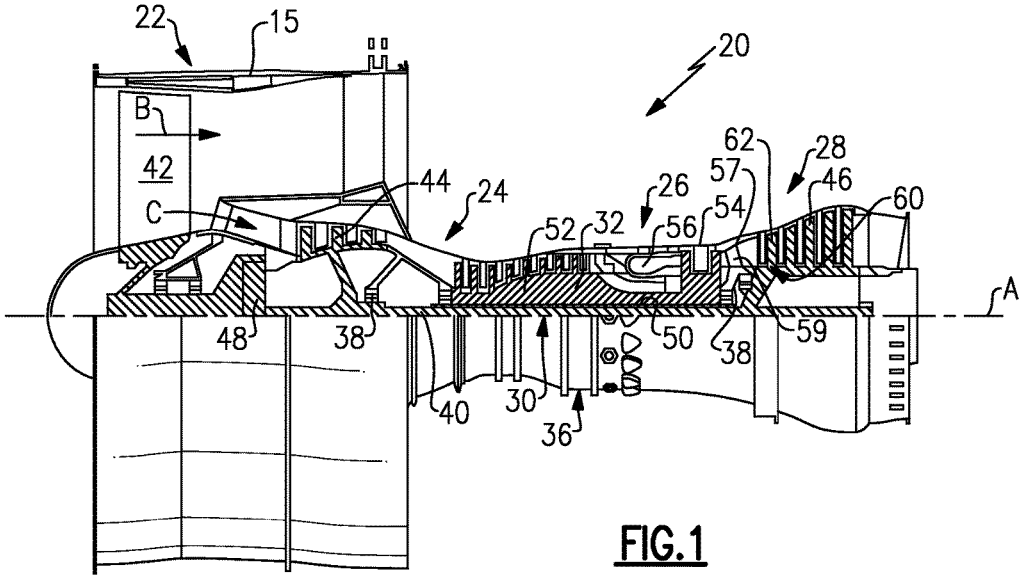
FIG. 1 illustrates an example gas turbine engine.

FIG. 1 schematically illustrates a gas turbine engine 20. The gas turbine engine 20 is disclosed herein as a two-spool turbofan that incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, it is to be understood that the concepts described herein are not limited to use with two-spool turbofans and the teachings can be applied to other types of turbine engines, including three-spool architectures and ground-based engines.

The engine 20 includes a low speed spool 30 and a high speed spool 32 mounted for rotation about an engine central axis A relative to an engine static structure 36 via several bearing systems, shown at 38. It is to be understood that various bearing systems at various locations may alternatively or additionally be provided, and the location of bearing systems may be varied as appropriate to the application.

The low speed spool 30 includes an inner shaft 40 that interconnects a fan 42, a low pressure compressor 44 and a low pressure turbine 46. The inner shaft 40 is connected to the fan 42 through a speed change mechanism, which in this example is a gear system 48, to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. A mid-turbine frame 57 of the engine static structure 36 is arranged between the high pressure turbine 54 and the low pressure turbine 46. The mid-turbine frame 57 further supports bearing system 38 in the turbine section 28. The inner shaft 40 and the outer shaft 50 are concentric and rotate via, for example, bearing systems 38 about the engine central axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and gear system 48 can be varied. For example, gear system 48 may be located aft of combustor section 26 or even aft of turbine section 28, and fan section 22 may be positioned forward or aft of the location of gear system 48.

The engine 20 in one example is a high-bypass geared engine. In a further example, the engine 20 has a bypass ratio that is greater than about six (6), with an example embodiment being greater than about ten (10), the gear system 48 is an epicyclic gear train, such as a planet or star gear system, with a gear reduction ratio of greater than about 2.3, and the low pressure turbine 46 has a pressure ratio that is greater than about five (5). In one disclosed embodiment, the bypass ratio is greater than about ten (10:1), the fan diameter is significantly larger than that of the low pressure compressor 44, and the low pressure turbine 46 has a pressure ratio that is greater than about five (5). Low pressure turbine 46 pressure ratio is pressure measured prior to inlet of low pressure turbine 46 as related to the pressure at the outlet of the low pressure turbine 46 prior to an exhaust nozzle. The gear system 48 can be an epicycle gear train, such as a planet or star gear system, with a gear reduction ratio of greater than about 2.3:1. It is to be understood, however, that the above parameters are only exemplary and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram } °R)/(518.7\ °R)]^{0.5}$. The "Low corrected fan tip speed" as disclosed herein according to one non-limiting embodiment is less than about 1150 ft/second.

The engine 20 includes a rotor assembly 60 (shown schematically) that is rotatable about the engine central axis A. In this example, the rotor assembly 60 is in the turbine section 28 and is a first stage rotor of the high pressure turbine 54. Turbine blades 62 are mounted on the rotor assembly 60. It is to be understood that although the examples herein are described with reference to the rotor assembly 60 being in the turbine section 28, the examples are not limited to the turbine section 28, high pressure turbine 54 or first stage rotor.

Figure 2:
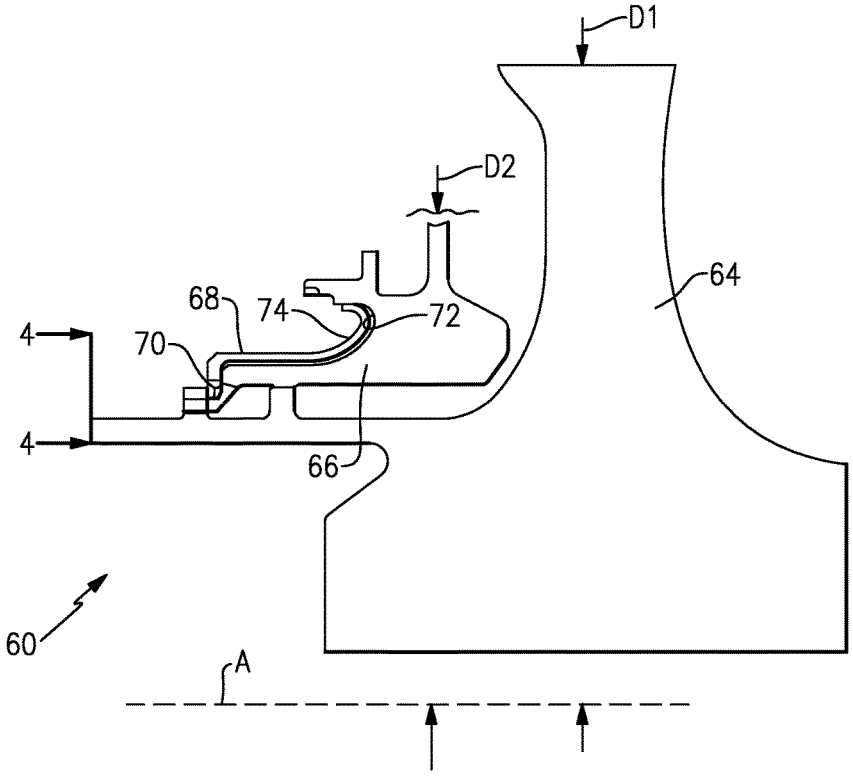
FIG. 2 illustrates an axial cross-section of a rotor assembly of the gas turbine engine of FIG. 1.

FIG. 2 illustrates an isolated axial cross-sectional view of the rotor assembly 60. The rotor assembly 60 includes a first rotor 64, a second rotor 66 that is mounted on the first rotor 64 and co-rotatable there with, and a thermal shield 68 interlocked with the second rotor 66 for co-rotation there with. That is, rotation of the first rotor 64 causes the second rotor 66 and thermal shield 68 to co-rotate with each other and with the first rotor 64. The first rotor 64, the second rotor 66 and the thermal shield 68 can be formed of superalloy materials, such as but not limited to nickel- or cobalt-based alloys, ceramics, composites and the like.

In this example, the second rotor 66 (which can alternatively be termed a "mini-rotor" or "mini-disk") is generally smaller in mass than the first rotor 64, which carries the turbine blades 62. The first rotor 64 has an outer diameter D1 (with respect to engine central axis A) and the second rotor 66 has a second diameter D2 (with respect to engine central axis A) that is smaller than the first diameter D1. The first rotor 64 serves to carry the turbine blades 62, while the second rotor 66 serves to provide secondary functions, such as but not limited to sealing. In this regard, the second rotor 66 can include one or more sealing features (not shown), such as knife seals.

Figure 3:
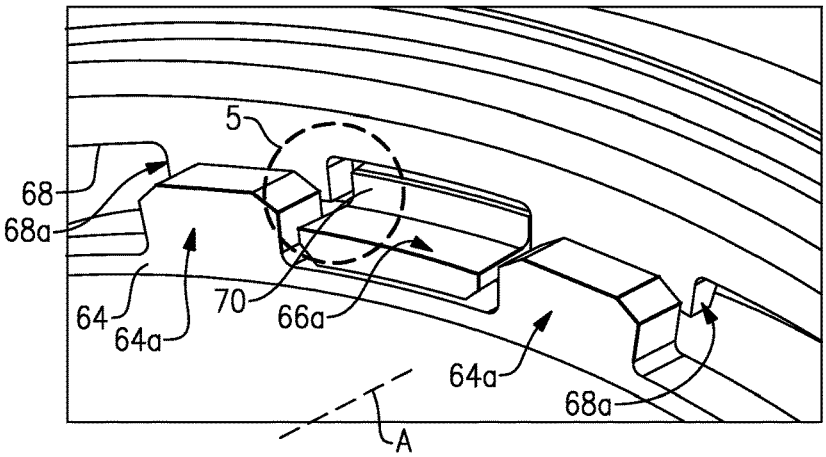
FIG. 3 illustrates a perspective view of a portion of the rotor assembly of FIG. 2.
Figure 4:
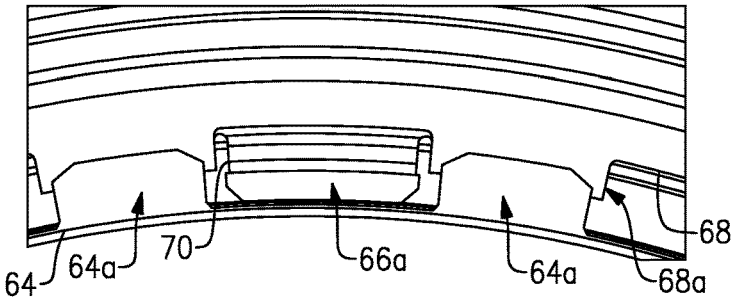
FIG. 4 illustrates an axial view of a portion of the rotor assembly of FIG. 2.
Figure 5:
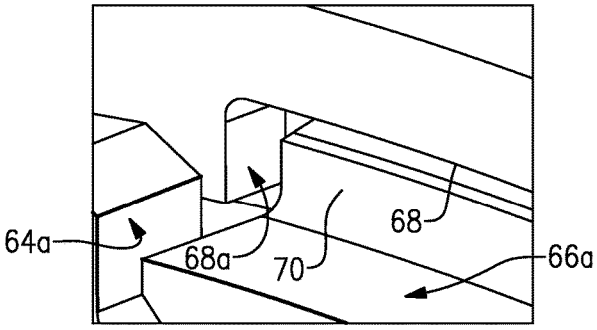
FIG. 5 illustrates a magnified view of a portion of the rotor assembly of FIG. 2.

Referring also to FIG. 3 showing a perspective view of a portion of the rotor assembly 60, FIG. 4 showing an axial view of a portion of the rotor assembly 60 and FIG. 5 showing a magnified perspective view of a portion of the rotor assembly 60, the second rotor 66 includes at least one tab 66*a* and the thermal shield 68 includes at least one tab 68*a*. As described in further detail below, the at least one tab 66*a* of the second rotor 66 circumferentially interlocks with the at least one tab 68*a* of the thermal shield 68 to secure the thermal shield 68 in place. It is to be understood that relative positional terms, such as "forward," "aft," "circumferential," "radial" and the like are with reference to the normal operational attitude of the engine 20 and engine central axis A, unless otherwise indicated.

In the illustrated example, the second rotor 66 includes a plurality of the tabs 66*a* and the thermal shield 68 includes a plurality of the tabs 68*a*, although only one of each of the tabs 66*a*/68*a* is needed for circumferential interlocking. The tabs 66*a* extend radially outwards and are circumferentially-spaced. The tabs 68*a* extend radially inwards and are also circumferentially-spaced. The tabs 66*a* are circumferentially interlocked with the tabs 68*a* such that the second rotor 66 and thermal shield 68 are locked for co-rotation.

Figure 6:
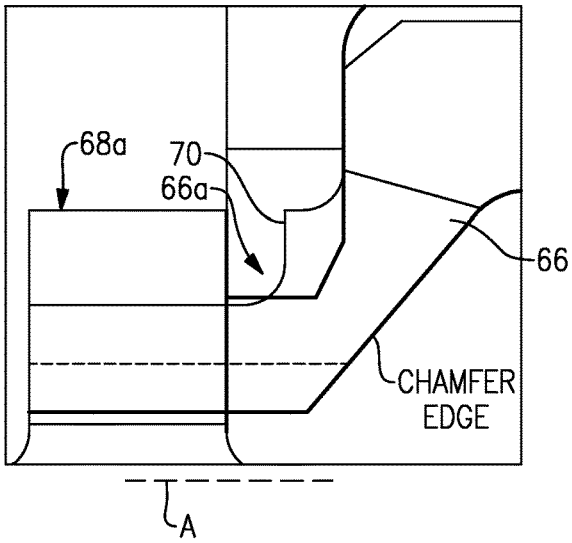
FIG. 6 illustrates an axial cross-sectional view of a tab of a second rotor of the rotor assembly of FIG. 2.

FIG. 6 shows an axial cross-section of a portion of the second rotor 66 and a representative one of the tabs 66*a*. As shown, the tab 66*a* has a step 70. The circumferential sides of the step 70 are proximate the respective circumferential sides of the tabs 68*a* on the thermal shield 68. Upon rotation of the rotor assembly 60, the circumferential sides of the step 70 can abut the respective circumferential sides of the tabs 68*a* on the thermal shield 68.

The second rotor 66 includes an axially-facing pocket 72 (FIG. 2) formed in a radially outer portion thereof relative to the tabs 66*a*. The thermal shield 68 includes a corresponding curved portion 74 that nests or seats in the pocket 72 such that the curved portion 74 contacts the wall of the pocket 72. In this example, in a fully nested or seated position, there is a gap between the portion and the walls of the pocket 72, which can facilitate thermal shielding.

Figure 7:
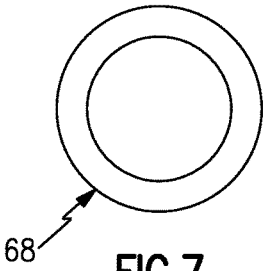
FIG. 7 illustrates a thermal shield of a rotor assembly as a continuous ring.

The first rotor 64 also includes at least one tab 64*a* (FIG. 3). In this example, the first rotor 64 includes a plurality of the tabs 64*a*. The tabs 64*a* extend radially outwards and are circumferentially-spaced. In a fully assembled state of the rotor assembly 60, the tabs 64*a* are circumferentially aligned with, and axially offset from, the tabs 68*a* of the thermal shield 68. The tabs 68*a* are circumferentially offset from, and axially aligned with, the steps 70 of the tabs 66*a* of the second rotor 66. The lower forward portions of the tabs 66*a* circumferentially interlock with the tabs 64*a* such that the second rotor 66 co-rotates with the first rotor 64. Further, the tabs 68*a* of the thermal shield 68 are axially trapped between the second rotor 66 and the tabs 64*a* of the first rotor 64. The thermal shield 68 is thus axially and circumferentially locked in position by the first rotor 64 and the second rotor 66, without the use of an additional fastener or fastening device. In this regard, the thermal shield 68 need not be split (i.e., a split ring) and can instead be a continuous ring, as schematically shown in FIG. 7.

Figure 8:
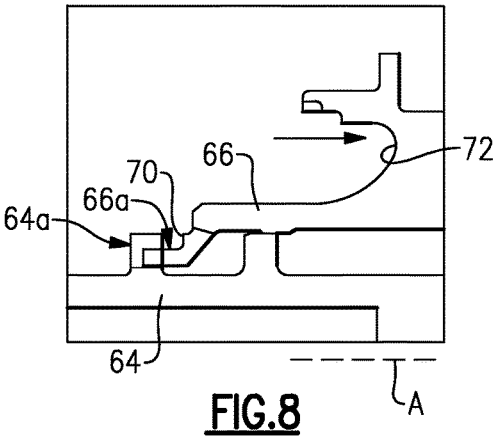
FIG. 8 illustrates mounting of a second rotor onto a first rotor of a rotor assembly.
Figure 9A:
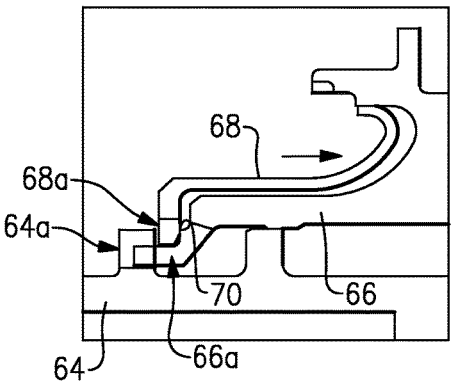
FIG. 9A illustrates an axial cross-sectional view of mounting a thermal shield onto a second rotor of a rotor assembly.
Figure 9B:
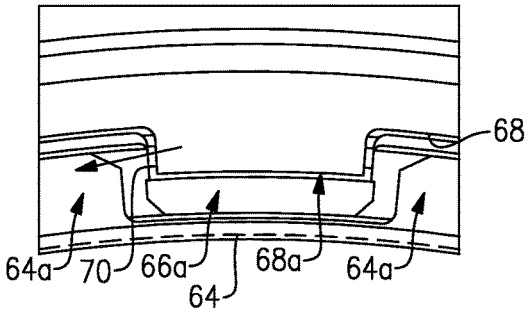
FIG. 9B illustrates an axial view according to the section line shown in FIG. 9A.
Figure 10:
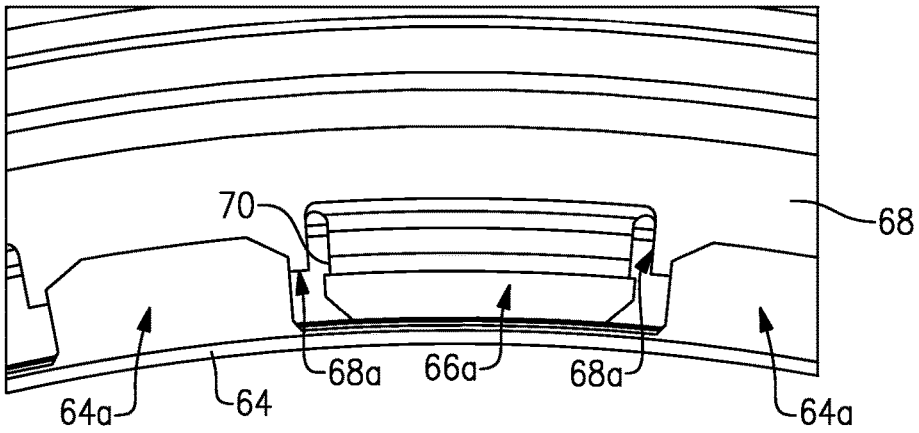
FIG. 10 illustrates an axial view of rotating a thermal shield during assembly of a rotor assembly.
Figure 11:
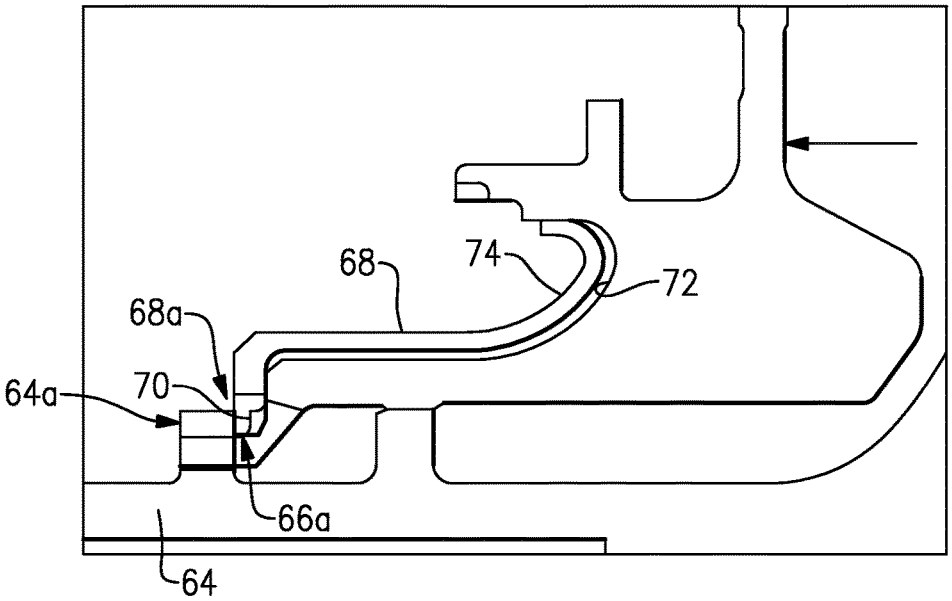
FIG. 11 illustrates an axial cross-sectional view of moving a second rotor axially forward during assembly of a rotor assembly.

FIG. 8, FIGS. 9A/9B, FIG. 10 and FIG. 11 illustrate various views of the rotor assembly 60 through a method of assembling the rotor assembly 60. In a broad example, the method includes interlocking the thermal shield 68 with the second rotor 66 for co-rotation there with.

The following further examples describe assembly of the second rotor 66 onto the first rotor 64, and assembly of the thermal shield 68 onto the second rotor 66. Referring to FIG. 8, the second rotor 66 is mounted onto the first rotor 64. For example, the second rotor 66 is mounted such that the tabs 66*a* are circumferentially misaligned with, and axially offset from, the tabs 64*a* of the first rotor 64. That is, the second rotor 66 is axially "over-seated" from its fully assembled position in which the tabs 66*a* are axially aligned with the tabs 64*a* of the first rotor 64.

Referring to FIGS. 9A/9B, the thermal shield 68 is then mounted onto the second rotor 68. To mount the thermal shield 68, the tabs 68*a* are circumferentially aligned with the tabs 66*a* of the second rotor 66 and circumferentially misaligned with the tabs 64*a* of the first rotor 64 such that the tabs 68*a* are received between and through the spaces between the tabs 64*a*. The thermal shield 68 is moved such that the tabs 68*a* axially clear the tabs 64*a*. As shown in FIG. 10, the thermal shield 68 is then rotated (either clockwise or counterclockwise) such that the tabs 68*a* move out of circumferential alignment with the tabs 66*a* of the second rotor 66 and into circumferential alignment with the tabs 64*a* of the first rotor 64.

Referring to FIG. 11, the second rotor 66 is then moved axially forward (to the left in FIG. 11) into a fully seated position relative to the thermal shield 68 and first rotor 64. The axial forward movement moves the lower forward portions of the tabs 66*a* of the second rotor 66 into axial alignment with the tabs 64*a* of the first rotor 64, thus circumferentially interlocking the second rotor 66 and the first rotor 64. The axial forward movement also moves the steps 70 of the tabs 66*a* of the second rotor 66 into axial alignment with the tabs 68*a* of the thermal shield 68, thus circumferentially interlocking the thermal shield 68 and the second rotor 68. The axial forward movement additionally moves the curved portion 74 of the thermal shield 68 into a nested or seated position in the pocket 72 of the second rotor 66.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure.

What is claimed is:

1. A rotor assembly comprising:

a first rotor;

a second rotor mounted on the first rotor and co-rotatable there with; and a thermal shield interlocked with the second rotor for co-rotation there with, wherein the first rotor has a first outer diameter and the second rotor has a second outer diameter that is smaller than the first outer diameter, and the second rotor includes at least one radially-extending tab and the thermal shield includes at least one radially-extending tab circumferentially interlocked with the at least one radially-extending tab of the second rotor.

2. The rotor assembly as recited in claim 1, wherein the at least one radially-extending tab of the second rotor includes a step.

3. The rotor assembly as recited in claim 1, wherein the second rotor includes a plurality of radially-extending circumferentially-spaced tabs and the thermal shield includes a plurality of radially-extending circumferentially-spaced tabs circumferentially interlocked with the plurality of radially-extending circumferentially-spaced tabs of the second rotor.

4. The rotor assembly as recited in claim 3, wherein the first rotor includes a plurality of radially-extending circumferentially-spaced tabs and the plurality of radially-extending circumferentially-spaced tabs of the second rotor are circumferentially interlocked with the plurality of radially-extending circumferentially-spaced tabs of the first rotor.

5. The rotor assembly as recited in claim 4, wherein the plurality of radially-extending circumferentially-spaced tabs of the thermal shield are circumferentially aligned with the plurality of radially-extending circumferentially-spaced tabs of the first rotor.

6. The rotor assembly as recited in claim 4, wherein the plurality of radially-extending circumferentially-spaced tabs of the thermal shield are axially trapped between the second rotor and the plurality of radially-extending circumferentially-spaced tabs of the first rotor.

7. The rotor assembly as recited in claim 1, wherein the second rotor includes an axially-facing pocket, and a portion of the thermal shield is seated in the axially-facing pocket.

8. The rotor assembly as recited in claim 1, wherein the thermal shield is a continuous ring.

9. A gas turbine engine comprising:

a first rotor;

a second rotor mounted on the first rotor and co-rotatable there with; and a thermal shield interlocked with the second rotor for co-rotation there with, wherein the first rotor has a first outer diameter and the second rotor has a second outer diameter that is smaller than the first outer diameter, and the second rotor includes at least one radially-extending tab and the thermal shield includes at least one radially-extending tab circumferentially interlocked with the at least one radially-extending tab of the second rotor.

10. A method of assembling a rotor assembly, the method comprising:

interlocking a thermal shield with a second rotor for co-rotation there with, the second rotor being mounted on a first rotor and co-rotatable there with, wherein the first rotor has a first outer diameter and the second rotor has a second outer diameter that is smaller than the first outer diameter, and the second rotor includes at least one radially-extending tab and the thermal shield includes at least one radially-extending tab circumferentially interlocked with the at least one radially-extending tab of the second rotor.

11. The method as recited in claim 10, wherein the interlocking includes mounting the thermal shield on the second rotor and rotating the thermal shield to circumferentially misalign the at least one radially-extending tab on the thermal shield with the at least one radially-extending tab on the second rotor.

12. The method as recited in claim 11, wherein the at least one radially-extending tab on the thermal shield is axially offset with respect to the at least one radially-extending tab on the second rotor.

13. The method as recited in claim 12, wherein the interlocking includes moving the second rotor relative to the thermal shield to axially align, and circumferentially interlock, the at least one radially-extending tab on the thermal shield with the at least one radially-extending tab on the second rotor.

* * * * *